US006544095B1

(12) United States Patent
Zimmerman

(10) Patent No.: US 6,544,095 B1
(45) Date of Patent: Apr. 8, 2003

(54) TOY AND METHOD OF PLAY

(76) Inventor: Luis R Zimmerman, 10233 N. Armenia Ave., Tampa, FL (US) 33612

( * ) Notice: Subject to any disclaimer, the term of this patent is extended or adjusted under 35 U.S.C. 154(b) by 0 days.

(21) Appl. No.: 10/004,367

(22) Filed: Nov. 1, 2001

(51) Int. Cl.[7] ..... A63H 1/02
(52) U.S. Cl. ..... 446/240; 273/449; 473/514
(58) Field of Search ..... 446/34, 35, 37, 446/39, 240, 266, 235–236, 242, 243, 244–247, 450–453; 273/449–450; 473/514; D21/399, 400

(56) References Cited

U.S. PATENT DOCUMENTS 2,167,992 A * 8/1939 Olsen
3,106,039 A * 10/1963 Simpson
3,528,659 A * 9/1970 Benham
4,118,030 A * 10/1978 Ranon ..... 276/96 R
4,750,745 A * 6/1988 Benham ..... 273/327
4,830,364 A * 5/1989 Wexler ..... 272/93
4,881,741 A * 11/1989 Shapiro ..... 273/327
4,895,377 A * 1/1990 Arbor ..... 273/327
5,039,108 A * 8/1991 Arbor ..... 273/327
5,788,590 A * 8/1998 Ervin ..... 473/514

* cited by examiner

*Primary Examiner*—Derris H. Banks
*Assistant Examiner*—Jamila Williams

(57) ABSTRACT

A control device and an elongated member provide for a controlled play wherein the elongated member remains aloft during play in response to controlled movement of the control device by a player. Contact by the control device with the elongated member includes a sliding contact, a pushing disengaging contact and a catching engaging contact. The elongated member may have numerous configurations where a plurality of contact surfaces are symmetrically disposed about a central axis. Preferably the elongated member will have a wide central portion which is bordered by opposing narrower intermediate portions which in turn are respectively bordered by end portions which are wider than the intermediate portions. The elongated member may be a rigid member, as formed by a molding process or from a permanent assembly of components, or may be of a sectional design which may be assembled and disassembled.

11 Claims, 7 Drawing Sheets

FIG. 8
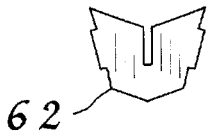
FIG. 9
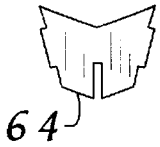
FIG. 10
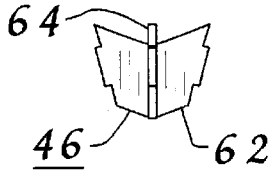
FIG. 11
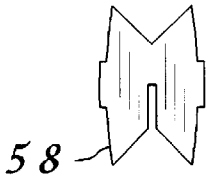
FIG. 12
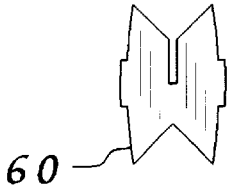
FIG. 13
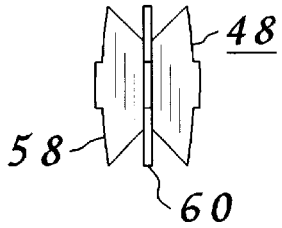
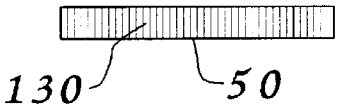
FIG. 14
FIG. 15
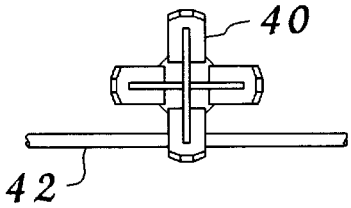
FIG. 24
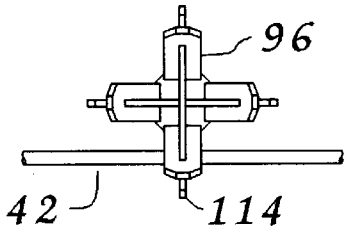
FIG. 16
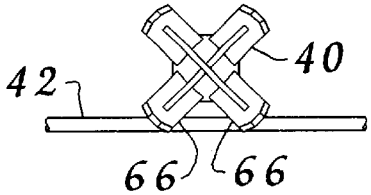
FIG. 25
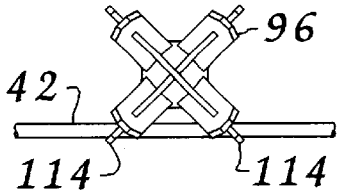

FIG. 26
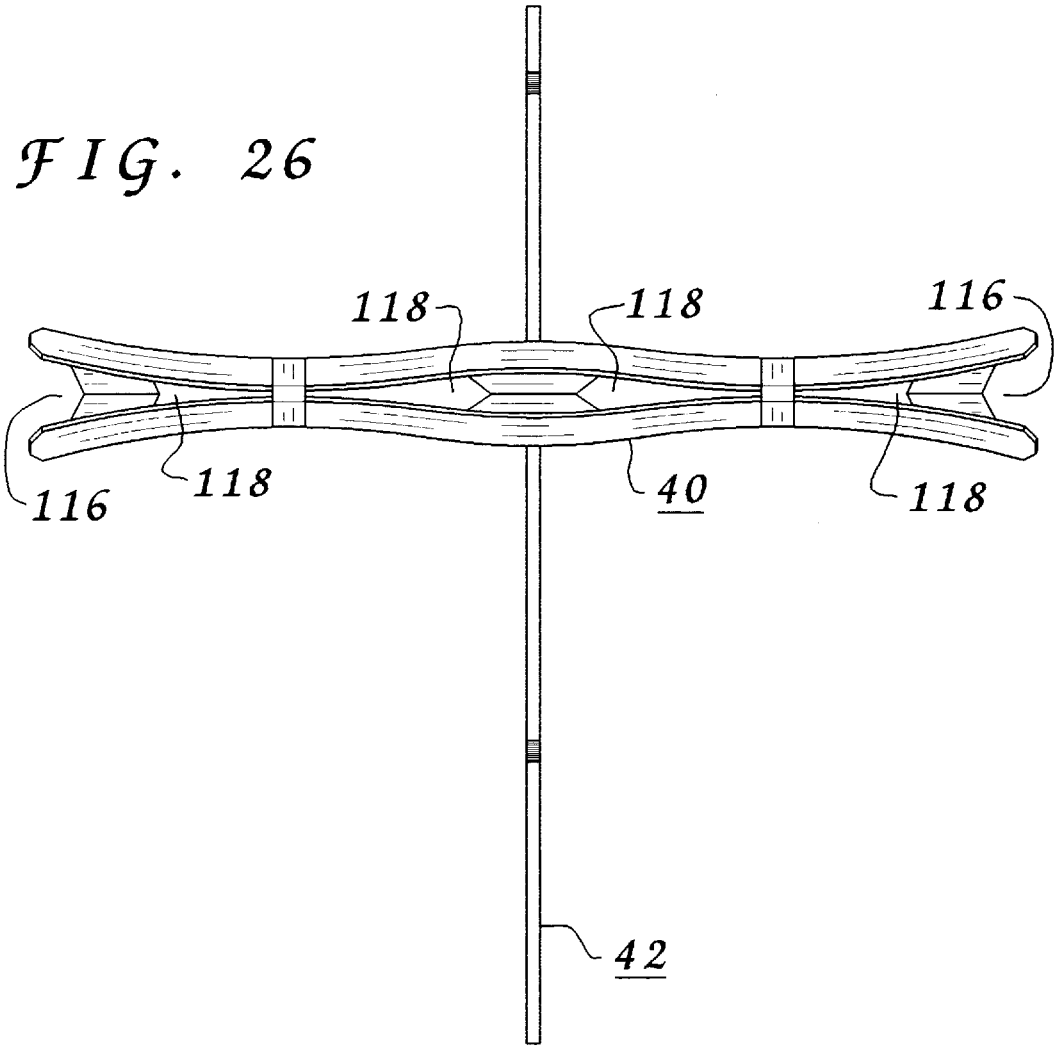
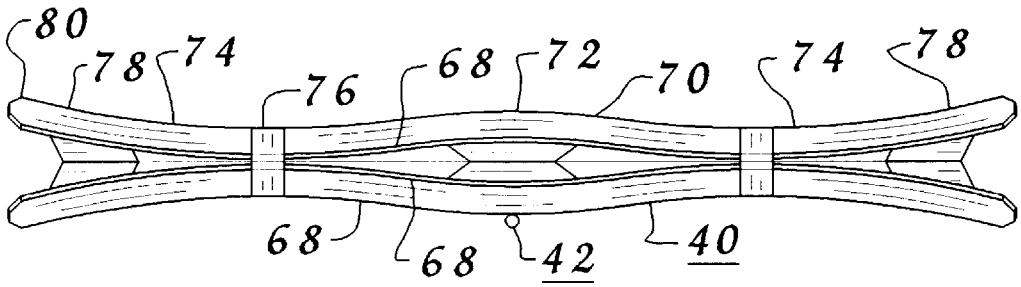
FIG. 27

FIG. 28
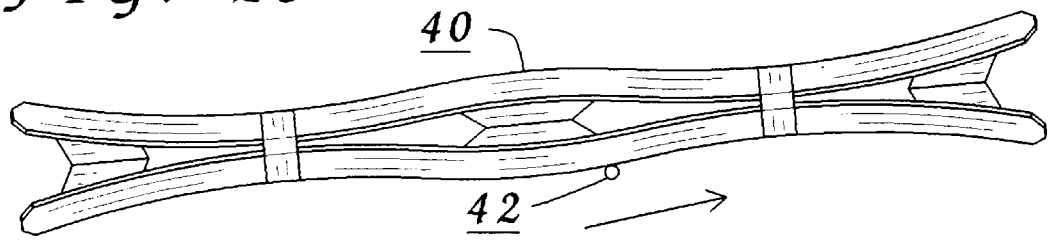
FIG. 29
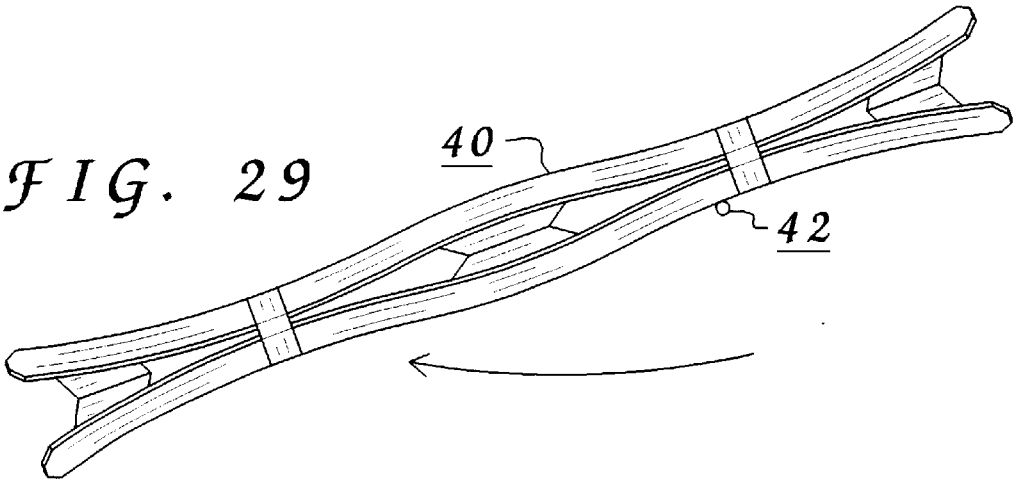
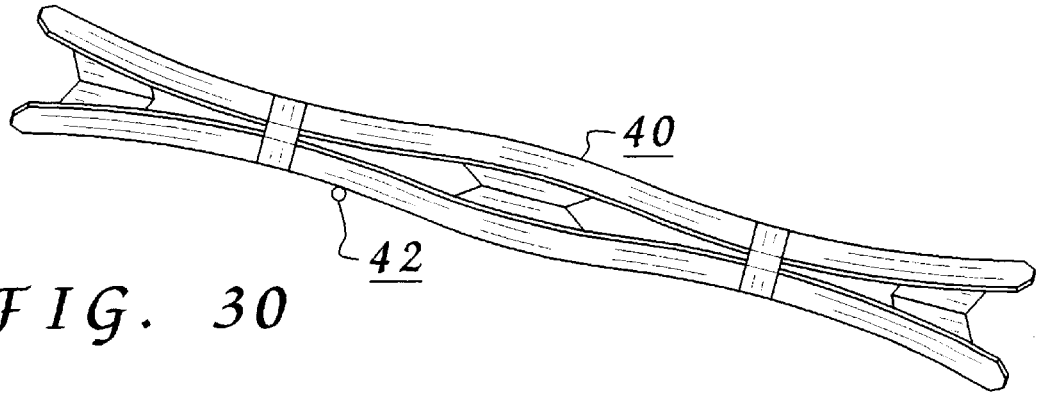
FIG. 30

FIG. 32
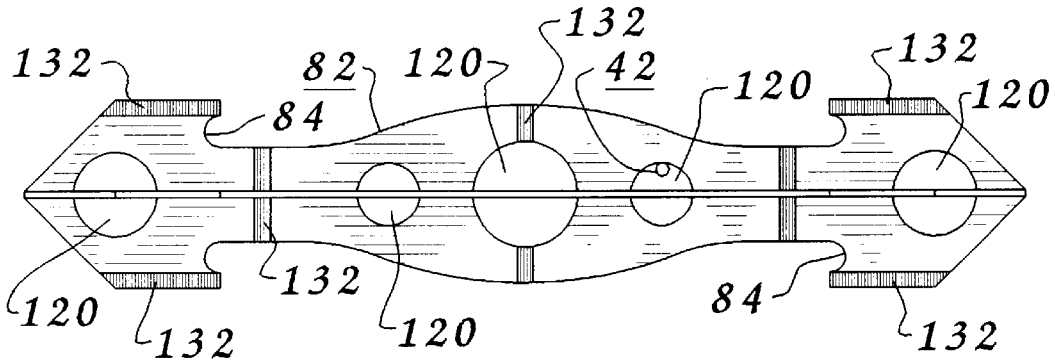
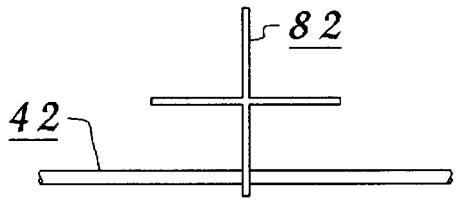
FIG. 33
FIG. 34
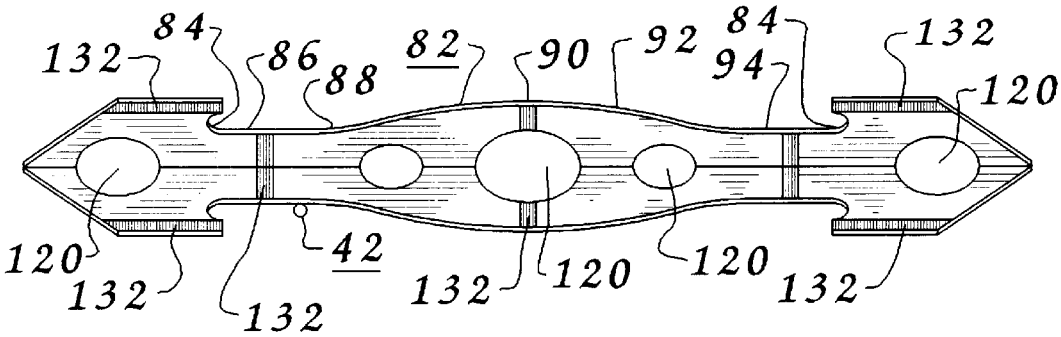
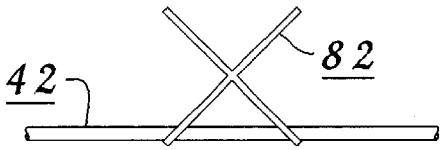
FIG. 35

TOY AND METHOD OF PLAY

BACKGROUND

1. Field of the Invention

Generally, the invention relates to toys. More specifically, the invention relates to such toys wherein an elongated member is maintained in an elevated play area above the ground utilizing manipulation of a control device and various sliding engagements between the control device and the elongated member.

2. Description of the Prior Art

Numerous toys, and associated methods of play, exist to entertain people. These include toys where a person manipulates the toy to maintain the toy, or a portion thereof, in an elevated position in front of the player. Often the player will hold one or two sticks and repetitively strike a detached member with the sticks to keep the detached member from reaching the ground. This class of toy provides the player with an enjoyable experience and acts as a training device for hand/eye coordination.

Various deficiencies exist with this class of toy due to the limited intermittent contact of the stick or sticks with the detached member. The player fails to experience a sense of full control over the detached member due to the repetitive bouncing around of the detached member.

As can be seen various attempts have been made to provide for a toy capable of entertaining both children and adults while allowing the player to enhance his or her motor skills. These attempts have been less efficient than desired. As such, it may be appreciated that there continues to be a need for a toy where the player is allowed to develop skills which enable full control to be exerted by the player over a detached elevated member including sliding contacts, pushing contacts and catching contacts. The present invention substantially fulfills these needs.

SUMMARY

In view of the foregoing disadvantages inherent in the known types of toys, your applicant has devised a toy, and an associated method of play, which enables the player to fully develop the ability to control the toy during controlled play in an elevated area above the ground. The toy has a control device and an elongated member. The player handles and manipulates the control device, which preferably is a long thin member, during the controlled play. The player uses the control device to maintain the elongated member in an elevated condition utilizing at least sliding contacts between the control device and the elongated member. The elongated member has various symmetrically disposed contact surfaces thereon which extend between opposing end portions, through opposing intermediate portions and a central portion. These various portions are in fluid communication along the respective contact surfaces where the control device may be freely slid along the contact surfaces while the elongated member pivots back and forth to be maintained in the elevated position during the play.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a toy which will provide the player with many hours of enjoyable activity while improving the player's hand/eye coordination.

Other objects include;

a) to provide for an elongated member which may be manipulated by a control device held by the player wherein the elongated member is maintained in an elevated position during play.

b) to provide for sliding contacts between the control device and the elongated member wherein the elongated member pivots back and forth during play.

c) to provide for pushing disengagement contacts between the control device and the elongated member wherein the elongated member is airborne without contact with the control device during periods of time during play.

d) to provide for catching engagement contacts between the control device and the elongated member wherein the elongated member comes back into contact with the control device following being airborne and out of contact with the control device.

e) to provide for stop members on the elongated member to limit movement of the control device along the elongated member.

f) to provide for twirling passages in the elongated member for placement therein of the control device for engaged twirling action play.

g) to provide for visual markings on the control device or on the elongated member, or on both, as tools to enable the player to more properly control the play.

h) to provide for end stand slots in the elongated member to enable the player to balance the elongated member on the control device during play.

i) to provide for a plurality of spaced contact surfaces to be symmetrically disposed about the elongated member.

j) to provide for the elongated member to be assembled for play and disassembled for transport or storage.

k) to provide for the elongated member to be formed by a molding process as a single, three dimensional, piece.

l) to provide for a construction of the elongated member from a plurality of planar pieces wherein the pieces having the contact surfaces thereon are spaced from a central axis of the elongated member.

m) to provide for a construction of the elongated member from a planar material wherein symmetrically disposed panels radiate outward from a central axis of the elongated member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 8 is a front elevational view of a first part of an end spacer member.

FIG. 9 is a front elevational view of a second part of the end spacer member.

FIG. 10 is a front elevational view of the end spacer member formed by the first part shown in FIG. 8 and the second part shown in FIG. 9.

FIG. 11 is a front elevational view of a first part of a center spacer member.

FIG. 12 is a front elevational view of a second part of the center spacer member.

FIG. 13 is a front elevational view of the center spacer member formed by the first part shown in FIG. 11 and the second part shown in FIG. 12.

FIG. 14 is a front elevational view of a material strip used to form a securing band.

FIG. 15 is an end elevational view of the elongated member shown in FIG. 1 and positioned on the control device.

FIG. 16 is an end elevational view of the elongated member shown in FIG. 15 in a preferred play position on the control device.

FIG. 24 is an end elevational view of the elongated member shown in FIG. 17 and positioned on the control device.

FIG. 25 is an end elevational view of the elongated member shown in FIG. 24 in a preferred play position on the control device.

FIG. 26 is a top plan view of the elongated member shown in FIG. 1 positioned on the control device shown in FIG. 2.

FIG. 27 is a front elevational view of the assembly shown in FIG. 26.

FIG. 28, FIG. 29 and FIG. 30 are front elevational view of the assembly shown in FIG. 27 depicting a sequence of play involving sliding engagement contacts between the elongated member and the control device.

FIG. 32 is a front elevational view of another embodiment of the elongated member having visual markings thereon with the control device positioned within a twirling passage.

FIG. 33 is an end elevational view of the elongated member shown in FIG. 32 positioned on the control device.

FIG. 34 is a front elevational view of the elongated member shown in FIG. 32 with the control device positioned within opposing twirling passages while the elongated member is in a preferred play position.

FIG. 35 is an end elevational view of the elongated member shown in FIG. 34 positioned in a preferred play position on the control device.

DESCRIPTION

Figure 1:
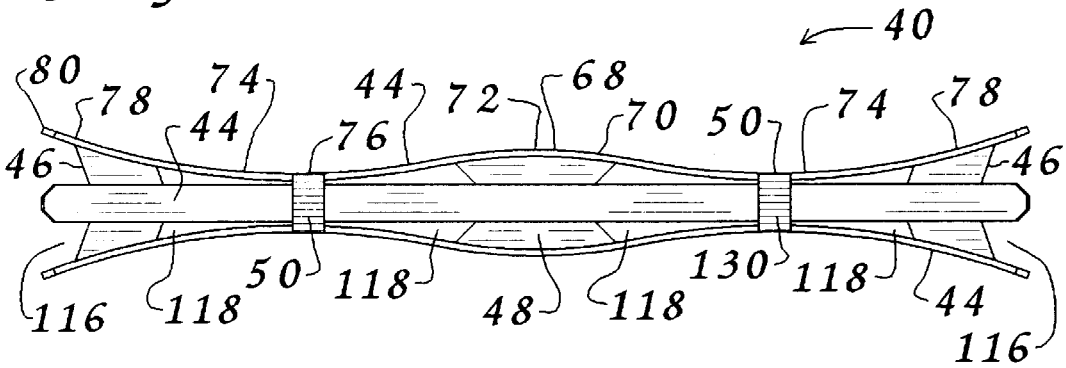
FIG. 1 is a front elevational view of an elongated member.

Many different toys having features of the present invention are possible. The following description describes the preferred embodiment of select features of those toys and various combinations thereof. These features may be deployed in various combinations to arrive at various desired working configurations of toys.

Reference is hereafter made to the drawings where like reference numerals refer to like parts throughout the various views.

Construction of the Toy

Toys having features of the present invention will have a control device, which is manually manipulated by the player, and an elongated member, which is manipulated by the player using the manipulations of the control device.

The elongated member may be formed from many different materials, utilizing various construction techniques, and have numerous configurations. Preferably the elongated member will be constructed to have various surface areas, either planar or curved. Ideally the construction material will be of an extremely light material where the resultant elongated member will be light and easy to manage during play. Examples of such light material include those having hollow areas, as depicted in the preferred embodiment depicted herein, or those of a foam material having a multiplicity of small air pockets contained therein.

Each elongated member will have a central axis extending therethrough align with the longitudinal length with the contact surfaces of the elongated member symmetrically disposed about the central axis. The structural elements which have the contact surfaces positioned thereon may be spaced from the central axis or they may converge at the central axis. When they are spaced from the central axis spacer members may be employed to provide support for these structural elements. When spacer members are employed it is possible to provide securing bands to provide the desired structural integrity to the elongated member during play.

Figure 2:
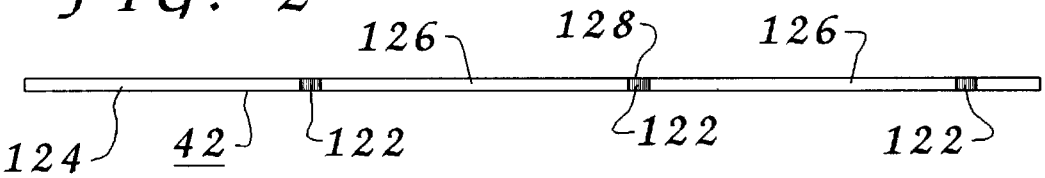
FIG. 2 is a side elevational view of a control device.
Figure 3:
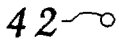
FIG. 3 is an end elevational view of the control device shown in FIG. 2.
Figure 4:
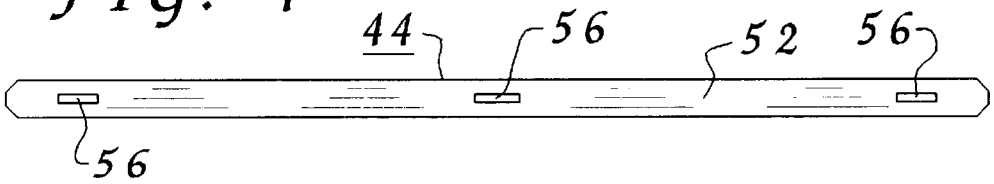
FIG. 4 is a rear elevational view of a strip member.
Figure 5:
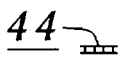
FIG. 5 is an end elevational view of the strip member shown in FIG. 4.
Figure 6:
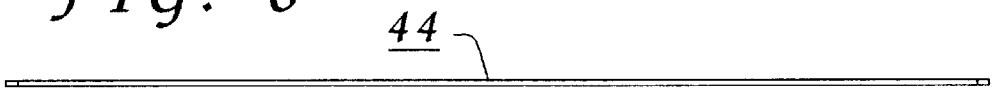
FIG. 6 is a side elevational view of the strip member shown in FIG. 4.
Figure 7:
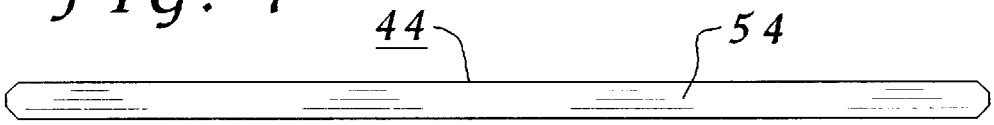
FIG. 7 is a front elevational view of the strip member shown in FIG. 4.

FIG. 1 depicts a preferred embodiment of an elongated member 40 while FIG. 2 depicts a preferred embodiment of a control device 42. A combination of a control device, in any of the various configurations possible, and an elongated member, in any of the various configurations possible, cooperate to form a toy having features of the present invention.

The control device may have various shapes and configurations as long as the player may readily manipulate it to provide control over the elongated member.

A preferred embodiment of control device 42 is depicted in FIG. 2, FIG. 3, FIG. 15, FIG. 16 and FIG. 24 through FIG. 35 as being straight and having a round crosssection along the entire length.

The elongated member must have plural contact surfaces radially disposed about a central axis. These contact surfaces may provide for contact with the control device using only one of the surfaces at a time or, more preferably, may be so disposed and configured that any pair of adjacent contact surfaces cooperate to provide for the contact with the control device for a more stable play. Preferably, each of the elongated members having features of the present invention will have five loosely defined portions disposed along a longitudinal length of the elongated member with the elongated member symmetrically configured along the longitudinal length about the central axis. These portions, or regions, may loosely be defined as a central portion, opposing intermediate portions and opposing end portions. It is a requirement that each of the contact surfaces extend along a substantial portion of the elongated member from one end to the opposing end but not necessarily entirely to the ends. The various contact surfaces which extend along the elongated member preferably will be smooth during transition from each portion to each adjacent portion to allow for ready sliding contact by the control device therealong. The central portion will be generally symmetrically disposed about an imaginary plane which perpendicularly intersects the central axis of the elongated member. The central portion will have a midpoint with a spacing from the central axis generally at this imaginary plane. The contact surfaces at the central portion will then taper downward toward the central axis on opposing sides of the imaginary plane. The opposing intermediate portions are positioned on opposing sides of the central portion distal from the imaginary plane. The opposing intermediate portions are generally symmetrical one to the other on opposing sides of the imaginary plane. The opposing intermediate portions have the points of each contact surface which are closest to the central axis of the elongated member positioned thereon. The opposing end portions are each positioned beyond a respective intermediate portion distal from the imaginary plane. Preferably, each end portion extends away from the central axis of the elongated member during travel away from the central portion.

Elongated member 40, shown in FIG. 1, FIG. 15, FIG. 16 and FIG. 26 through FIG. 31, is formed from four (4) strip members 44, see FIG. 1 and FIG. 4 through FIG. 7, two (2) end spacer members 46, see FIG. 1 and FIG. 10, one (1) center spacer member 48, see FIG. 1 and FIG. 13, and two (2) securing bands 50, see FIG. 1 and FIG. 14. In this preferred embodiment strip members 44 are formed of a resilient durable flexible material having hollow sections therein, see FIG. 5. Such material is conventionally known in the art as formed from a plastic and commonly used to form many types of containers. Each strip member 44 has an inner surface 52, see FIG. 4, and an outer surface 54, see FIG. 7. Inner surface 52 of each strip member 44 has various coupling slots 56 formed therein which receive a portion of a respective end spacer member 46 or a portion of center spacer member 48. Preferably each end spacer member 46 and center spacer member 48 are formed of the same material as used to form strip members 44. Center spacer member 48 is formed of a first part 58, see FIG. 11, and a second part 60, see FIG. 12, which mount together. Each end spacer member 46 is formed of a first part 62, see FIG. 8, and a second part 64, see FIG. 9, which mount together. Each securing band 50 is formed of a flexible material which is bound together, or otherwise adhered together, to form an endless loop. During assembly of elongated member 40 center spacer member 48 is assembled, two (2) end spacer members 46 are assembled and two (2) securing bands 50 are assembled. Following these procedures the four (4) strip members 44 are attached to center spacer member 48 utilizing coupling slots 56. Following this procedure the two (2) securing bands 50 are installed from opposing ends over strip members 44. Following this procedure each end spacer member 46 is installed at a respective end and mounted relative to coupling slots 56. Following this procedure securing bands 50 are repositioned if necessary.

Referring now specifically to FIG. 1, FIG. 15 and FIG. 16 it is realized that there exist eight (8) contact surfaces on elongated member 40 for true contact with control device 42. These include four (4) where control device 42 makes contact with, and across, outer surface 54 of a respective strip member 44 and four (4) where control device 42 makes contact with adjacent edges 66, see FIG. 16, of adjacent strip members 44.

FIG. 1 and FIG. 27 depict elongated member 40 as viewed along the longitudinal length in two orientation positions. A plurality of contact surfaces 68 are radially disposed about the central axis of elongated member 40. A central portion 70 of elongated member 40 has a highest elevational point 72 on each contact surface 68 measured from the central axis of elongated member 40. Opposing intermediate portions 74 of elongated member 40 each have a lowest elevational point 76 on each contact surface 68 measured from the central axis of elongated member 40. Opposing end portions 78 of elongated member 40 extend away from the central axis of elongated member 40 during travel away from central portion 70 and have a highest elevational point 80. Highest elevational point 80 may have a greater spacing from the central axis than highest elevational point 72 of central portion 70, as shown, or may have a lesser spacing from the central axis than highest elevational point 72 of central portion 70.

Stop members may be provided at opposing ends of each of the contact surfaces, or between each opposing set of contact surfaces, to restrict movement of the control device therebetween. Such restriction providing for an easier manipulation of the elongated member during play. Therefore, stop members may be a tool to use during training to enable users to more quickly master play with the toy. The stop members, when provided, may be permanent or, more preferably, temporary where they may be removed as the player gains more control over the play.

FIG. 34 depicts an elongated member 82 having permanent stop members 84. During sliding contacts during play control device 42 may be moved from a first end portion 86 through a first intermediate portion 88, through a central portion 90, through a second intermediate portion 92 and into a second end portion 94 without concern that control device 42 will lose contact with elongated member 82 beyond second end portion 94 due to a presence of stop member 84. The opposing stop members 84 will similarly prevent loss of contact with elongated member 82 during movement of control device 42 from second end portion 94 to first end portion 86.

Figure 17:
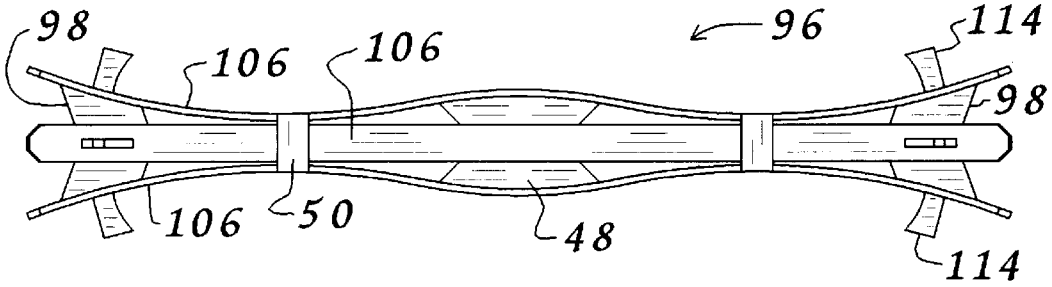
FIG. 17 is a front elevational view of an elongated member having end spacer members having stop member extensions thereon installed therein.
Figure 18:
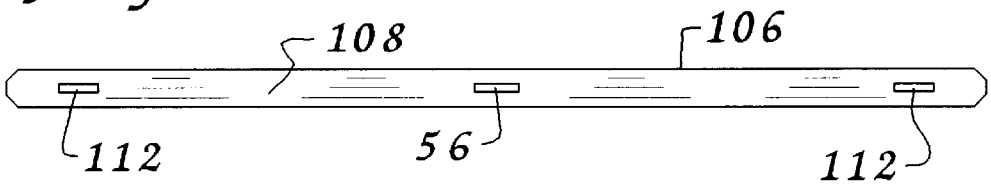
FIG. 18 is a rear elevational view of a strip member used in the elongated member shown in FIG. 17.
Figure 19:
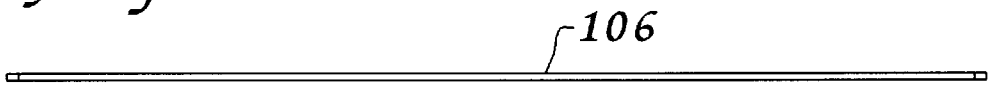
FIG. 19 is a side elevational view of the strip member shown in FIG. 18.
Figure 20:
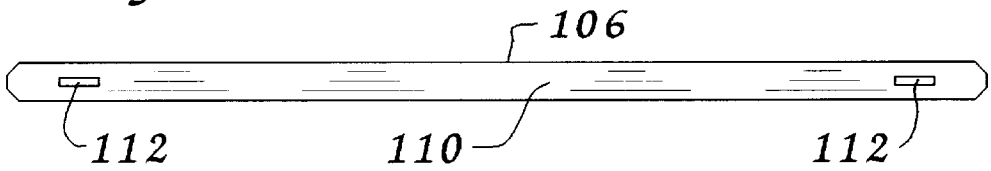
FIG. 20 is a front elevational view of the strip member shown in FIG. 18.
Figure 21:
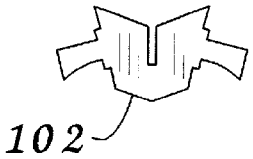
FIG. 21 is a front elevational view of a first part of an end spacer member having the stop member extensions.
Figure 22:
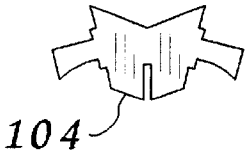
FIG. 22 is a front elevational view of a second part of the end spacer member having the stop member extensions.
Figure 23:
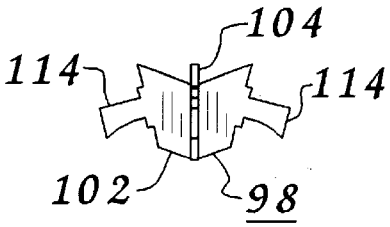
FIG. 23 is a front elevational view of the end spacer member having the stop member extensions formed by the first part shown in FIG. 21 and the second part shown in FIG. 22.

FIG. 17 depicts an elongated member 96 having end spacer members 98 having stop members 100 positioned thereon. FIG. 21 depicts a first part 102 while FIG. 22 depicts a second part 104. FIG. 23 depicts end spacer member 98 as formed by first part 102 and second part 104. Elongated member 96 is formed from four (4) strip members 106, see FIG. 17 through FIG. 20, two (2) end spacer members 98, see FIG. 17 and FIG. 23, one (1) center spacer member 48, see FIG. 13 and FIG. 17, and two (2) securing bands 50, see FIG. 14 and FIG. 17. Each strip member 106 has an interior surface 108, see FIG. 18, and an exterior surface 110, see FIG. 20. Each strip member 106 has a coupling slot 56, see FIG. 18, which penetrates interior surface 108 for attachment to center spacer member 48. Each strip member also has opposing coupling slots 112, see FIG. 18 and FIG. 20, which penetrates both interior surface 108 and exterior surface 110 for attachment to end spacer members 98. Each end spacer member 98 has a plurality of extensions 114, see FIG. 17 and FIG. 23, which extend beyond coupling slot 112 to act as stop members.

FIG. 15 and FIG. 16 depict elongated member 40 positioned on control device 42 in two possible orientations. As can readily be observed elongated member 40 may slide off of control device 42 during sliding contacts during play. FIG. 24 and FIG. 25 depict elongated member 96 positioned on control device 42 in two possible orientations. As can readily be observed elongated member 96, having extensions 114 positioned thereon, will be prevented from sliding off of control device 42 during sliding contacts during play.

Balancing slots may be provided at opposing ends of the elongated member to provide for additional play techniques during play. The balancing slots may be used to allow the player to catch the elongated member using the control device when the elongated member is generally vertical and then, if desired, allow the player to balance the elongated member in a general vertical orientation using the control device.

FIG. 1 and FIG. 26 depict balancing slots 116 positioned at opposing ends of elongated member 40. Each balancing slot 116, when elongated member 40 is generally vertical, is formed by surfaces of end spacer member 46 bordered by surfaces of strip members 44.

Twirling passages may be positioned on the elongated member. These passages provide for insertion therein of the control device during play. Due to the confining qualities of the passages the elongated member may be spun on the control device without undue concern for loss of the control.

FIG. 1 and FIG. 26 depict twirling passages 118 within elongated member 40 formed by gaps between strip members 44. Twirling passages may include being bordered by portions of end spacer members 46, center spacer member 48 or securing bands 50. FIG. 32 and FIG. 34 depict twirling passages 120 within elongated member 82. In this embodiment twirling passages 120 are holes or voids formed in the material used to construct elongated member 82.

Visual markings may be provided on the control device, on the elongated member or on both the control device or the elongated member. Such markings may provide visual guidance to permit the player to better perform the play.

FIG. 2 depicts control device 42 having visual bands 122 positioned thereon. Visual bands 122 are used to segregate a handle grip area 124 from a play zone 126. Visual band 122 is also used to identify a center 128 of play zone 126. FIG. 1 depicts elongated member 40 which uses visual markings 130 on securing bands 50 to allow the player to readily identify locations on elongated member 40 during play. FIG. 32 and FIG. 34 depict an extensive use of visual markings 132 on elongated member 82 to determine orientation during play.

Play with the Toy

It is a strong desire for the player to maintain the elongated member in an elevated position above the ground using the control device during extended play. This may involve any select contact of the control device with the elongated member including complex combinations of contacts. Examples of such contacts include a sliding contact, a pushing disengaging contact, a catching engaging contact, a flipping action, a twirling contact and an end standing balancing contact. Typically it is desirable, particularly during sliding contacts, to retain the control device level with horizontal to prevent the elongated member from sliding inward toward the player or outward away from the player. Deliberate orientational changes of the control device from level may be utilized to reposition the elongated member at a more desirable placement relative to the control device during play.

A pushing disengaging contact occurs where the player uses the control device to force the elongated member into the air and the elongated member leaves contact with the control device.

Figure 31:
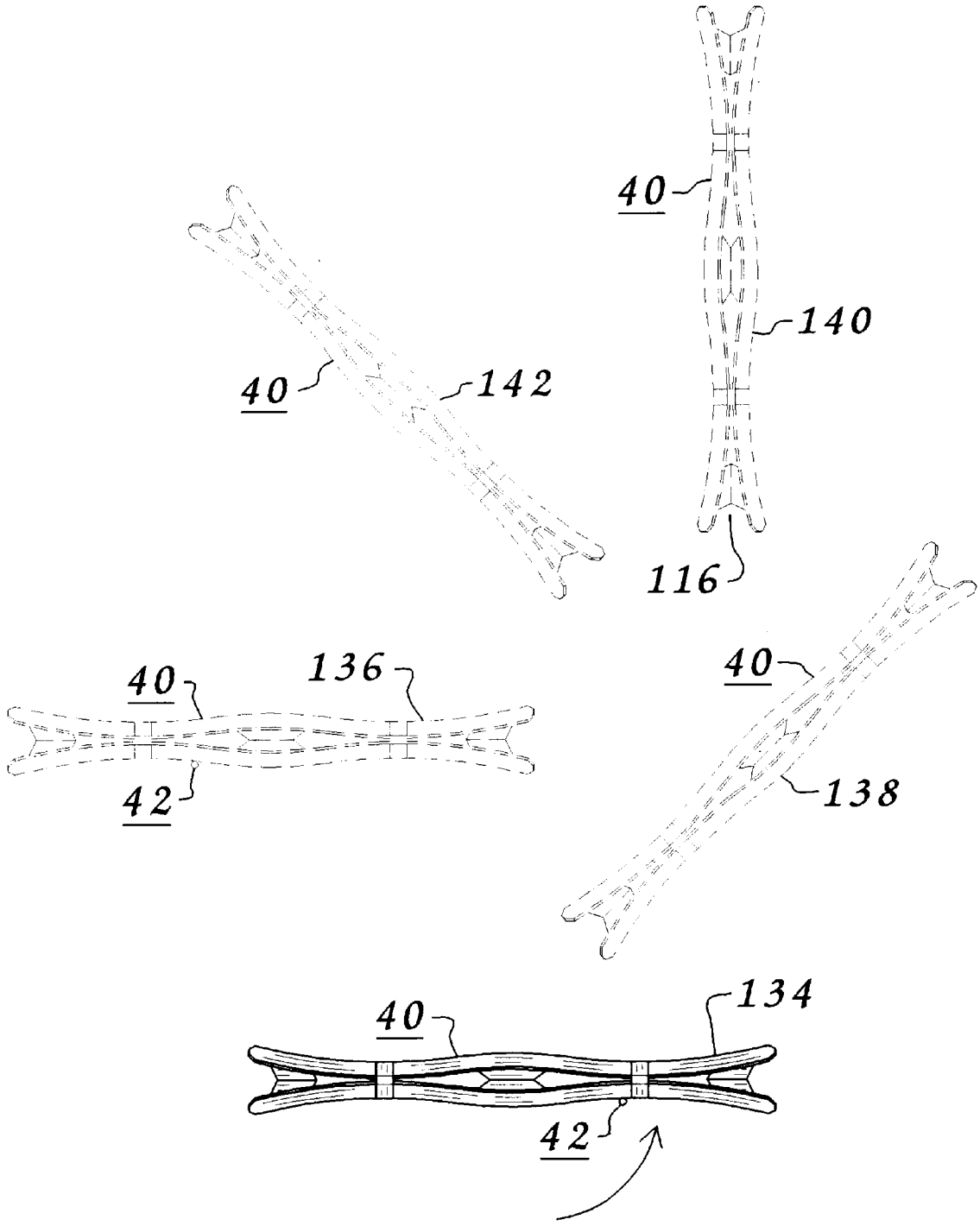
FIG. 31 is a front elevational view depicting a flipping operation including a pushing disengaging contact and a catching engaging contact.

FIG. 31 depicts elongated member 40 in contact with control device 42 at a positional orientation 134. From this position a forceful movement upward of control device 42 causes elongated member 40 to leave contact with control device 42 and become airborne. Such pushing disengagement contacts may occur while control device 42 is in many positions relative to elongated member 40 and while elongated member 40 is at many different spacial orientations.

It is possible to enjoy play with toys of the present invention utilizing only sliding contacts between the control device and the elongated member. Alternatively it is possible to utilize sliding contacts in combination with other types of contacts.

A sliding engagement contact occurs where the player uses manipulation of the control device to move the control device from one position on the elongated member to another position on the elongated member and spaced from the beginning position. During such movements, which preferably occur in a repetitive sequence, the elongated member pivots in response to placement of the control device, gravitational influences and momentum influences.

FIG. 28 through FIG. 29 depict a series of sliding motions of control device 42 along elongated member 40. FIG. 28 depicts one possible angular orientation of elongated member 40 relative to control device 42. FIG. 29 depicts one possible angular orientation of elongated member 40 relative to control device 42 following a sliding displacement of control device 42 along elongated member 40 using a sliding contact as depicted from FIG. 28 to FIG. 29. FIG. 30 depicts one possible angular orientation of elongated member 40 relative to control device 42 following a sliding displacement of control device 42 along elongated member 40 using a sliding contact as depicted from FIG. 29 to FIG. 30.

A catching engaging contact occurs where the player uses the control device to catch the elongated member following a state of being airborne. Such contact may occur during mere repositioning of the control device or subsequent to a pushing disengaging contact.

FIG. 31 depicts elongated member 40 coming into contact with control device 42 at a positional orientation 136. Such catching engaging contacts may occur while control device 42 is in many positions relative to elongated member 40 and while elongated member 40 is at many different spacial orientations.

A flipping action occurs where the central axis of the elongated member spatially rotates and where the opposing ends of the elongated member reverse position. This action may occur following a pushing disengaging contact, during mere repositioning of the control device during a sliding contact or following a catching engaging contact. The flipping action may occur where the elongated member makes two or more of the flipping rotations prior to making contact with the control device again or even during continuous contact with the control device.

FIG. 31 depict a flipping action where elongated member 40 moves from positional orientation 134, where elongated member 40 is in contact with control device 42, through airborne positional orientations 138, 140 and 142 to positional orientation 136, where elongated member 40 is back in contact with control device 42.

A twirling contact occurs where the control device is positioned within a twirling passage and the elongated member rotates relative to the control device.

FIG. 32 depicts placement of control device 42 within one of the twirling passages 120 of elongated member 82. While in this position rotational manipulation of control device 42 may cause a twirling action of elongated member 82 relative to control device 42.

An end stand contact occurs where the control device is used to engage an end of the elongated member and the elongated member is balanced thereon using manipulation of control device by the player while the elongated member is generally vertical. Ideally, a balancing slot is providing on the elongated member to make such manipulation easier for the player.

FIG. 31 depicts elongated member 40 in airborne positional orientation 140 where control device 42 may engage elongated member 40 at balancing slot 116. Following such engagement elongated member 40 may be balanced in a generally vertical orientation utilizing manipulation of control device 42.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

1 Toy control device and elongated member central portion—opposing intermediate portions—opposing end portions

2 intermittent contact

3 wide center—narrow intermediates—wide ends

4 multiple spaced contact surfaces with open region between

5 removable stop members

6 planar material

7/6 convergent at central axis

8/6 offset from central axis

9 Toy control device and elongated member plurality of smooth contact surfaces

10 spacer members and securing bands

11 ends have balancing slots

12 stops at end portions

13 twirling passages through toy

14 visual markings

15 planar material

16 Method of Play providing control device and elongated member contacts/catching engagement—sliding—pushing disengagement

17 flip—opposing ends of elongated member switch orientation

18 twirling—opposing ends of elongated member rotate at least once

19 engage ends to stand

20 multiple sliding contacts occur subsequent to catching engagement contact

I claim:

1. A toy for a controlled play in an elevated area above a ground surface by a player, the toy comprising:

a) a control device for manipulation by the player;

b) an elongated member for manipulation during the controlled play utilizing the control device, the elongated member having a central axis extending therethrough and aligned through a longitudinal length of the elongated member, the elongated member having a plurality of smooth contact surfaces disposed about the central axis, each smooth contact surface extending from a first end along a first end portion and along a first intermediate portion and along a central portion and along a second intermediate portion and along a second end portion to a second end, the first intermediate portion and the second intermediate portion each having a respective portion thereof at a closer spacing to the central axis then any portion of the central portion to the central axis and wherein the controlled play occurs utilizing any select adjacent pair of the smooth contact surfaces.

2. The toy defined in claim 1 wherein the elongated member further comprises a central spacer member to retain portions of the smooth contact surfaces at the central portion at a desired elevational spacing from the central axis and wherein the elongated member further comprises opposing end spacer members to retain respective portions of the smooth contact surfaces at the first end portion and the second end portion respectively at a desired elevational spacing from the central axis and wherein the elongated member further comprises opposing securing bands to retain respective portions of the smooth contact surfaces at the first intermediate portion and the second intermediate portion respectively at a desired elevational spacing from the central axis.

3. The toy defined in claim 1 wherein the elongated member further comprises opposing balancing engagement portions positioned at opposing ends of the elongated member and wherein the intermittent contact with the control device further comprises a balancing contact wherein the elongated member is retained substantially vertical utilizing a contact between the control device and one of the balancing engagement portions.

4. The toy defined in claim 1 wherein each of the smooth contact surface of the elongated member has opposing stop members positioned respectively in close proximity to the first end and the second end to restrict movement of the control device along the smooth contact surface during the sliding engagement contacts.

5. The toy defined in claim 1 wherein the elongated member further comprises a plurality of twirling passages wherein the elongated member may be twirled utilizing a contact of the control device through one of the twirling passages.

6. The toy defined in claim 1 wherein each of the smooth contact surfaces further comprises a plurality of visual markings thereon with each of the visual markings being indicative of a desired manipulation point therealong.

7. The toy defined in claim 1 wherein the elongated member is substantially formed from a planar material.

8. A toy for a controlled play in an elevated area above a ground surface by a player, the toy comprising:

a) a control device for manipulation by the player;

b) an elongated member for manipulation utilizing a sliding contact with the control device, the elongated member comprising:

1) a central portion;

2) opposing intermediate portions symmetrically disposed adjacent the central portion, each intermediate portion a continuation of the central portion;

3) opposing end portions symmetrically disposed about the central portion, each opposing end portion beyond a respective intermediate portion, each end portion a continuation of the respective intermediate portion;

4) a plurality of smooth contact surfaces and wherein each of the smooth contact surfaces extend from a first of the opposing end portions along a first of the intermediate portions along the central portion along a second of the intermediate portions and along a second of the end portions and wherein at least every other adjacent pair of the smooth contact surfaces has a twirling passage therebetween.

9. A toy for a controlled play in an elevated area above a ground surface by a player, the toy comprising:

a) a control device for manipulation by the player;

b) an elongated member for manipulation utilizing a sliding contact with the control device, the elongated member substantially formed from a planar material and comprising:

1) a central portion;

2) opposing intermediate portions symmetrically disposed adjacent the central portion, each intermediate portion a continuation of the central portion;

3) opposing end portions symmetrically disposed about the central portion, each opposing end portion beyond a respective intermediate portion, each end portion a continuation of the respective intermediate portion.

10. The toy defined in claim 9 wherein the elongated member further has a central axis extending therethrough and aligned through a longitudinal length of the elongated member and wherein the planar material generally converges at the central axis.

11. The toy defined in claim 9 wherein the elongated member further has a central axis extending therethrough and aligned through a longitudinal length of the elongated member and wherein the planar material which comprises the central portion, the opposing intermediate portions and the opposing end portions are substantially spaced from the central axis.

* * * * *